US008672297B2

(12) United States Patent
Schmitt et al.

(10) Patent No.: US 8,672,297 B2
(45) Date of Patent: Mar. 18, 2014

(54) SCISSOR LIFTING PLATFORM

(75) Inventors: Winfried Schmitt, Bichl (DE); Thomas Deuring, Hopferbach (DE)

(73) Assignee: MAHA Maschinebau Haldenwang GmbH & Co. KG, Haldenwang (DE)

( * ) Notice: Subject to any disclaimer, the term of this patent is extended or adjusted under 35 U.S.C. 154(b) by 807 days.

(21) Appl. No.: 12/764,793

(22) Filed: Apr. 21, 2010

(65) Prior Publication Data

US 2010/0270523 A1 Oct. 28, 2010

(30) Foreign Application Priority Data

Apr. 23, 2009 (DE) ..... 10 2009 002 613

(51) Int. Cl.
*B66F 3/24* (2006.01)
*B66F 3/22* (2006.01)
*B66F 3/00* (2006.01)

(52) U.S. Cl.
USPC ..... 254/93 R; 254/122; 254/128

(58) Field of Classification Search
USPC ..... 254/122–126, 93 R, 93 L
See application file for complete search history.

(56) References Cited

U.S. PATENT DOCUMENTS

| | | | | |
|---|---|---|---|---|
| 2,533,980 A | | 12/1950 | Weaver | |
| 4,114,854 A | | 9/1978 | Clark | |
| 4,157,743 A | | 6/1979 | Masuda et al. | |
| 4,373,701 A | * | 2/1983 | Kishi | 254/122 |
| 4,858,482 A | * | 8/1989 | Knudsen | 74/110 |
| 4,858,888 A | | 8/1989 | Cruz et al. | |
| 4,890,692 A | | 1/1990 | Oakman | |
| 5,192,053 A | * | 3/1993 | Sehlstedt | 254/122 |
| 5,636,711 A | | 6/1997 | Nussbaum | |
| 6,464,205 B2 | | 10/2002 | Wanner | |

FOREIGN PATENT DOCUMENTS

| | | |
|---|---|---|
| DE | 299 16 254 U1 | 4/2000 |
| EP | 0 136 986 A1 | 4/1985 |
| EP | 0 613 852 A1 | 9/1994 |
| FR | 2 673 926 A1 | 9/1992 |

OTHER PUBLICATIONS

EP Application No. 10 16 0550, European Patent Office Search Report, mail date Jul. 29, 2010 (3 pages).

* cited by examiner

*Primary Examiner* — Lee D Wilson
*Assistant Examiner* — Nirvana Deonauth
(74) *Attorney, Agent, or Firm* — Blakely Sokoloff Taylor & Zafman LLP

(57) ABSTRACT

Embodiments of a scissor lifting platform comprising at least two crossing lower scissor bars, at least two crossing upper scissor bars articulatedly connected to the lower scissor bars, and a lower joint connecting the two lower scissor bars with each other and an upper joint connecting the two upper scissor bars with each other. Furthermore, the scissor lifting platform comprises at least one lifting aggregate connected to the lower scissor bar or the upper scissor bar and at least one rail having at least one contact area and being supported on the upper scissor bars. The upper scissor bar is articulatedly connected to the at least one rail and the other one of the upper scissor bars is guided by the at least one rail so as to be movable in a longitudinal direction when the scissor lifting platform moves. The lifting aggregate has at least one operating rod which works together with an elevating mechanism for lifting and reinforcing the vertical force up to a predetermined lifting height of the scissor lifting platform.

14 Claims, 13 Drawing Sheets

SCISSOR LIFTING PLATFORM

TECHNICAL FIELD

The present invention relates to a scissor lifting platform, in particular for lifting vehicles, which requires a reduced lifting force in the starting phase of the lifting movement. In addition, the scissor lifting platform has a compact structure in the retracted position.

BACKGROUND

Scissor lifting platforms are used in a variety of technical fields for lifting loads of different types and optionally persons. Different models of scissor lifting platforms are also used to lift motor vehicles, in particular motorcars, off-road vehicles and vans, in repair shops, production companies and also testing stations due to the simple lifting technology, the sturdy style and the possibility to arrange the retracted scissor lifting platform at floor level.

At least two congruent scissors are used for the construction of the lifting mechanism. If it is intended that particularly great heights be reachable, a plurality of such pairs of scissors can be arranged on top of each other which results e.g. in double scissor lifting platforms or multiple scissor lifting platforms.

In a lowered state, scissor lifting platforms should have an overall height as low as possible in order to facilitate the application of the loads to be lifted in this position. Especially the lifting platforms for motor vehicles are meant to protrude as little as possible beyond the surface of the floor in their lowered position in order to thus make it easier to drive on the motor vehicles. In this case, it is furthermore possible to omit a separate installation pit at the assembly site.

However, in the case of scissor lifting platforms the problem arises that the scissor bars which can be pivoted against to each other have to lie in parallel, if possible, in the lowered state, resulting in unfavorable lever geometries for the lifting units in the starting phase of the lifting movement.

Generally, the further the point of application of the lifting cylinder at the bearing site of the scissor arm is removed from the associated pivoting point, the more advantageous the leverage becomes and consequently the required forces for pushing out the lifting cylinder decrease.

In a known double scissor lifting platform bearings for an articulated connection of a lower scissor and an upper scissor of a base frame side are respectively positioned at the adjacent ends of the scissor bars formed as straight supports. Therefore, when the platform is lowered the scissor bars cannot move into a completely horizontal position because the bearings each rest on the top surfaces of the scissor bars of the lower scissor. Thus, the scissor bars remain in a slight inclination which determines the minimum height of the platform in the lowered position, that is, the overall height.

From this another problem results, namely that less favorable fulcrum conditions for the lifting cylinders result when the lifting height decreases so that much higher pressure forces are required for the lifting cylinder(s) for lifting the lifting table or the like pick-up of loads of a lifting platform from the lowered position thereof as compared to the nominal load. Therefore, conventional scissor lifting platforms cannot be retracted any more than down to a lowered position in which the lifting cylinder engaging with the lifting platform still has an angle of application of 5° or more.

DE 26 20 902 A1 shows a lifting device comprising a working platform the lifting mechanism of which is formed in a kind of double scissor. In the retracted position of the working platform, at the beginning of the movement auxiliary cylinders respectively disposed at the corners of the working platform lift the latter up to a particular height. As soon as a particular position has been reached the shearing force of the main cylinder acts on the bars of the frame and subsequently lifts them. The use of the additional auxiliary cylinders increases the manufacturing costs of the lifting device and prevents a compact structural style of the working platform.

SUMMARY OF THE EMBODIMENTS

It is an object of the present invention to provide a scissor lifting platform which in a lowered state has a compact structure in order to reduce the forces required in the starting phase of the lifting movement.

This object is achieved according to the invention by the subject-matters of the independent claims. Advantageous developments and preferred embodiments of the invention are stated in the dependent claims.

According to the invention, there is provided a scissor lifting platform, particularly for motor vehicles, that may comprise at least two crossing lower scissor bars, at least two crossing upper scissor bars articulatedly connected to the lower scissor bars. Furthermore, the scissor lifting platform may have a lower joint connecting the two lower scissor bars with each other, an upper joint connecting the two upper scissor bars with each other, and at least one lifting aggregate connected to the lower scissor bar or the upper scissor bar. Furthermore, at least one rail having at least one contact area and being supported on the upper scissor bars may be provided. The upper scissor bar may be articulatedly connected to the at least one rail and the other one of the upper scissor bars may be guided by the at least one rail so as to be movable in a longitudinal direction when the scissor lifting platform moves. Moreover, the lifting aggregate may have at least one operating rod which works together with an elevating mechanism for lifting and reinforcing the vertical force up to a predetermined lifting height of the scissor lifting platform.

The (first) predetermined lifting height presents itself as that lifting height at which an expansion lever of the elevating mechanism is in contact with other components of the elevating mechanism, in particular the expansion lever retainer and the stop. While the scissor lifting platform is lifted the elevating mechanism may work together with the scissor bars such that an increased vertical force component can be provided already at a low lifting height whereby the lifting aggregate and the components in connection therewith can be reduced in dimension. Thus, the necessary component costs can be reduced while the load remains the same.

This inventive structure of the scissor lifting platform offers the advantage that in this way a very compact structure of the same can be implemented because the height of the scissor lifting platform in the lowered position is essentially predetermined only by the dimensioning of the supporting bars and the lifting aggregate, respectively.

Preferably, in a scissor lifting platform the elevating mechanism may have at least one expansion lever articulatedly connected to a head of the operating rod. Due to its cooperation with the other components of the elevating mechanism when the scissor lifting platform is lifted, the expansion lever may assume different angles with the operating rod so that it is possible to provide an increased vertical force component already at a low lifting height.

Furthermore, the expansion lever may have at least one rotatable roll at a longitudinal end thereof. The use of a rotatable roll primarily serves to lower the friction while the expansion lever moves on an expansion lever retainer towards a stop. In a further embodiment a body essentially shaped in an arbitrary manner may be provided instead of a rotatable roll, which body, however, should have low friction when moving. This body may be for example a sliding element.

Preferably, in a scissor lifting platform an expansion lever retainer may be provided on the scissor bar to which the operating rod is not connected, the expansion lever being in contact with the expansion lever retainer up to a predetermined second lifting height of the scissor bars. The second predetermined lifting height comes about as that lifting height at which the expansion lever is no longer in contact with the expansion lever retainer and the stop. Thus, the expansion lever is a detachable support. In a preferred embodiment, the stop may essentially extend perpendicularly to the expansion lever retainer, however, the stop may also be formed in an outwardly inclined manner, that is, pointing away from the lifting aggregate. Thus, the force for detaching the roll from the stop can be reduced. The height of the stop may be selected such that it corresponds at least to the radius of the roll.

In a preferred embodiment of the scissor lifting platform, the expansion lever retainer may have a stop, wherein the expansion lever exercises a reinforcing vertical force component on the operating rod and thus on the scissor bar connected to the lifting aggregate in case of an end-side contact with the expansion lever retainer and the stop. Furthermore, the magnitude of the reinforcing vertical force component of the expansion lever may be additionally influenced by the selection of the point of application of force from the operating rod into the scissor bar.

Furthermore, in a scissor lifting platform according to the invention, the elevating mechanism may have a lifting auxiliary member that is disposed at the head of the operating rod on the opposite side of the expansion lever. In a preferred embodiment the lifting auxiliary member may be a roll. Moreover, the lifting auxiliary member may be a sliding member of essentially arbitrary design, wherein the friction thereof should be as low as possible.

Preferably, the lifting auxiliary member in a scissor lifting platform should be in contact with a ramp area that extending upward from the expansion lever retainer and is connected to the scissor bar while the operating rod is extended from the lowered position. Thus, starting from the original horizontal orientation of the operating rod, a vertical force component of the operating rod can be implemented already at a very low lifting height and applied to the scissor bar. Furthermore, the auxiliary lifting member can lift from the ramp area by the expansion lever coming into contact with the stop and the expansion lever retainer.

Furthermore, in a scissor lifting platform a contact means may be provided at the head of the operating rod that works together with a guide disposed on the scissor bar connected to the operating rod, and allows force to be transferred between the operating rod and the scissor bar.

Preferably, in a scissor lifting platform the contact means may be a sliding pad that transfers an application of force of the operating rod to the scissor bar connected to the operating rod via the guide and moves relative to the guide upon an extension movement of the operating rod. The sliding pad may be made of red bronze. Furthermore, the sliding pad may work together with the guide such that the former is in contact with the guide at any arbitrary lifting height.

In a preferred embodiment in the scissor lifting platform the guide may have a hook-shaped section in the range of an inwardly turned longitudinal end, which section limits the movement of the contact means in one direction. Thereby, the movement of the contact means during the lifting or lowering of the scissor lifting platform may be limited such that a dangerous situation with regard to the guide of the contact means can be excluded.

Furthermore, in an inventive scissor lifting platform the operating rod may be disposed in a substantially horizontal manner in the lowered position. The horizontal disposition of the operating rod enables a very compact structure of the scissor lifting platform in the lowered position. If the scissor lifting platform is mounted in an installation pit, it is thus possible to reduce the depth of the installation pit.

Preferably, in a scissor lifting platform a stop plate may be arranged in a section of the scissor bar connected to the operating rod. In a preferred embodiment the stop plate may be disposed in an upper section of the scissor bar. Furthermore, however, the stop plate may also be disposed in any section along the height of the scissor bar.

Furthermore, in a scissor lifting platform the stop plate may have a limitation recess in the range of an inwardly turned longitudinal end, which limitation recess accommodates a limitation means disposed in the head of the operating rod and is able to prevent the head from being shifted in an inward direction above a third predetermined lifting height. The third predetermined lifting height presents itself as that lifting height at which the limitation means is in contact with the limitation recess.

In a preferred embodiment of the scissor lifting platform, the lifting aggregate may be a hydraulic lifting cylinder and the operating rod may be a piston rod of the hydraulic lifting cylinder.

Furthermore, in the scissor lifting platform the operating rod may be in operative connection with the upper scissor bars via the contact means and the guide. Moreover, however, the operating rod may also be in operative connection with the lower scissor bars via the contact means and the guide.

Below, an extension mechanism for a rail of a scissor lifting platform will be described, which may also be used by itself, that is, without the use of the above-described elevating mechanism according to the invention, with the scissor lifting platform.

The extension mechanism may comprise at least an extension member which can respectively be accommodated by a correspondingly shaped accommodation section in the rail. Furthermore, the extension mechanism may have at least one drive-on member which is rotatably connected to at least one extension member. The at least one extension member may be slidably guided in the accommodation section of the rail in an axial direction. The width of the drive-on member may be identical to the width of the rail, however, it may also differ therefrom. Furthermore, the extension mechanism may have a stop provided for limiting the axial offset of the at least one extension member away from the rail on the at least one extension member or on the accommodation section of the rail. Moreover, the extension mechanism may have a support member which may be brought into contact with both the drive-on member and at least one section of the at least one extension member. Furthermore, the support member may be movable with respect to the drive-on member by means of a lever. Moreover, a correspondingly designed accommodation section may be formed on the extension member for bringing it into contact with the support member.

Thus, the extension mechanism may implement a rail in which the contact area is of a variable length as well as a pivotable ramp for driving the vehicle onto/off the rail.

BRIEF DESCRIPTION OF THE DRAWINGS

Advantageous developments and further details of the present invention will be described below by using different embodiments with reference to the schematic Figures, wherein.

DETAILED DESCRIPTION OF THE ILLUSTRATED EMBODIMENTS

Embodiments of an apparatus system and method for a scissor lifting platform are described herein. In the following description, numerous specific details are described to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail but are nonetheless encompassed within the scope of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in this specification do not necessarily all refer to the same embodiment. Furthermore, the particular features, structures, or characteristics may be combined in any suitable manner in one or more embodiments.

Figure 1:
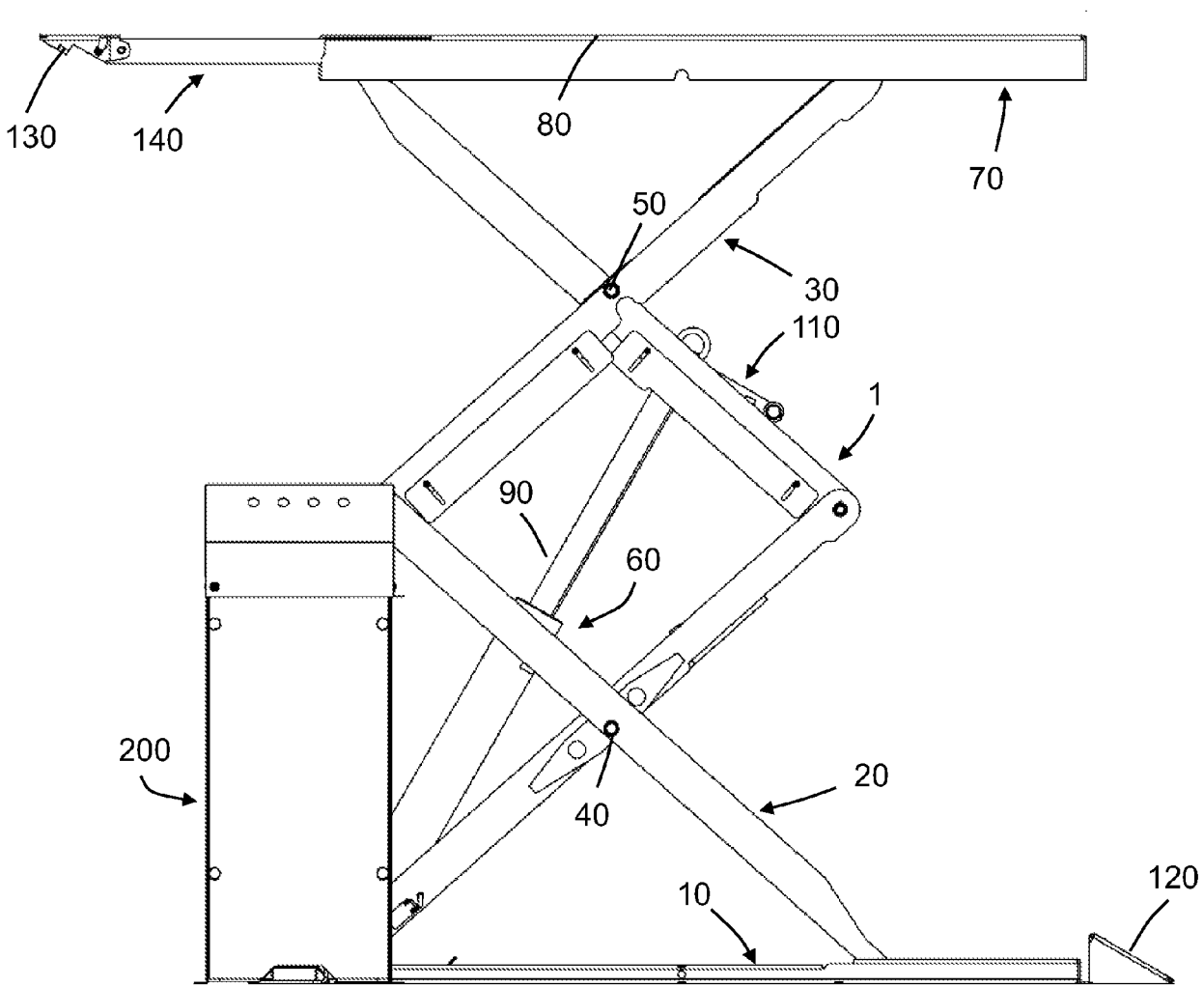
FIG. 1 shows a side view of a scissor lifting platform comprising an elevating mechanism according to the present invention.
Figure 2:
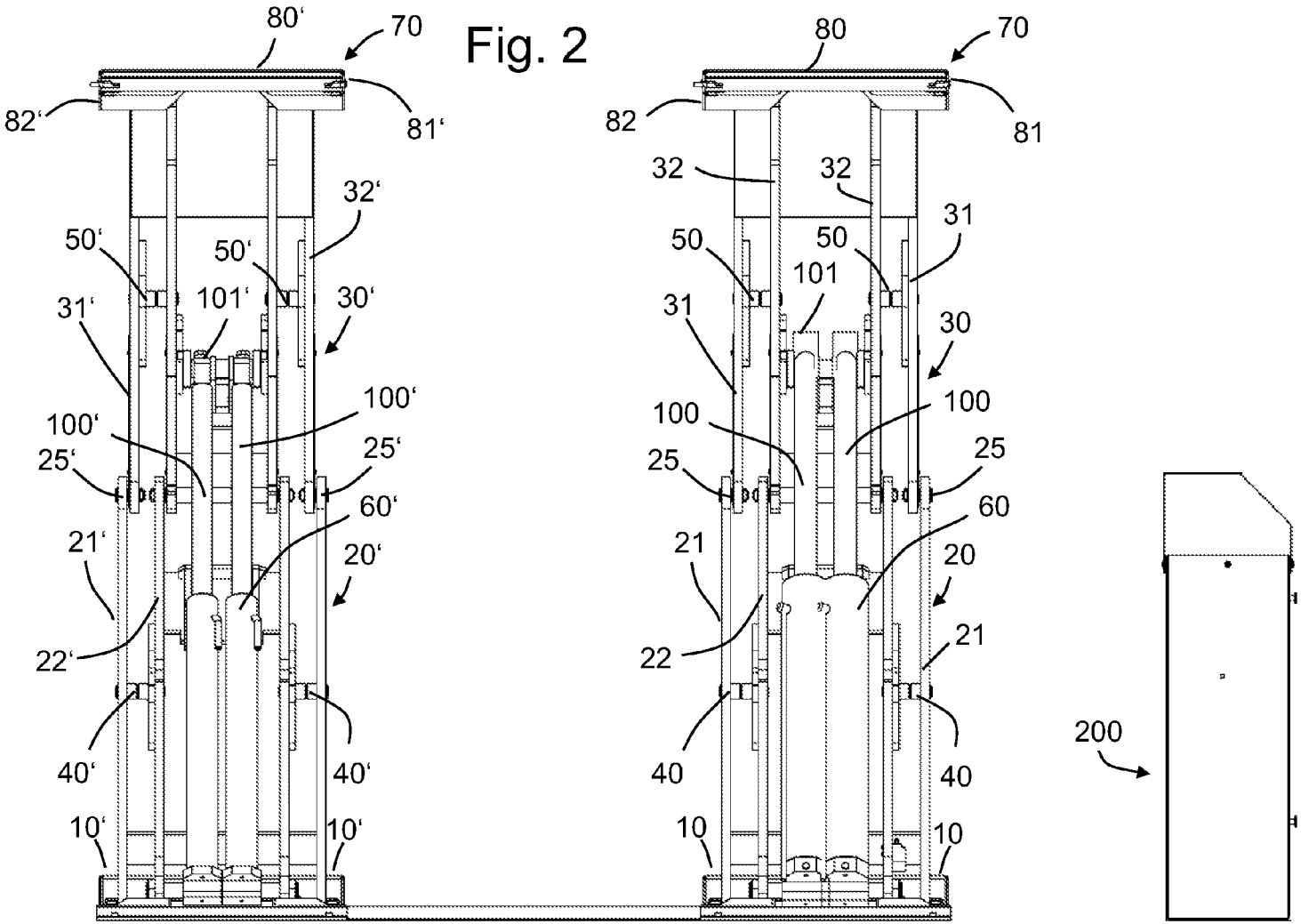
FIG. 2 shows a front view of the scissor lifting platform according to FIG. 1.

Referring to FIG. 1 and FIG. 2, a scissor lifting platform 1 according to the present invention is schematically shown. The double scissor lifting platform illustrated in FIG. 1 and FIG. 2 serves to lift lighter motor vehicles (not shown), in particular passenger cars, off-road vehicles, small trucks, etc. In the following, merely one half of the double scissor lifting platform 1 illustrated in FIG. 1 will be described. The second half of this lifting platform is constructed in the same way and disposed at a horizontal intermediate distance corresponding to approximately the gauge of the vehicle to be lifted. Thus, the left and right halves in FIG. 2 together form the double scissor lifting platform 1 for lifting and lowering a motor vehicle. The left half of the double scissor lifting platform 1 shown in FIG. 2 has the same components as the right half which are denoted by the same reference numerals provided with an apostrophe.

The double scissor lifting platform 1 has two support rail constructions of which only one can be seen in FIG. 1 and the second is concealed because it is disposed behind the former.

The support rail construction contains two parallel longitudinal rails 10, 10' which each have an inwardly open cross-section and are connected to a floor-side flat steel. The two longitudinal rails 10 are solidly connected to each other by an approximately plate-shaped crossbeam on which two bearing blocks (not shown) are respectively fixed to the ends. A horizontal fulcrum pin (not shown) is supported with the ends thereof in these bearing blocks to which fulcrum pin a supporting joint is centrally fixed for articulatedly supporting a lifting cylinder 90,90'. Immediately adjacent to the inner sides of the two bearing blocks, two support bars 21, 21', 22, 22' having conical end parts are fixed to the fulcrum pin, which together form a lower scissor bar 20. A ramp 120, 120' is disposed adjacent to a longitudinal end of the guide rail 10, 10', which ramp serves to drive on a vehicle to be lifted in the lowered position of the double scissor lifting platform 1.

A stopping or locking mechanism (not shown) is respectively provided on each of the lateral support or guide rails 10, 10', which locking mechanism is articulatedly connected to the lower conical ends of a respective lower support bar 21, 21', 22, 22'. As illustrated, the two lower support bars 21 and 22 and the two support bars 21' and 22' are articulatedly connected to each other by respective central bearing blocks 40, 40'.

The head 101, 101' of the piston rod 100, 100' of the lifting cylinder 90, 90' engages with an upper scissor mechanism 30, 30' so that the lower scissor bar 20, 20' and the upper scissor bar 30, 30' are mechanically coupled. When the lifting cylinder 90, 90' is pressurized by pressure fluid and thus extends its piston rod 100, 100', the two scissor bars 20, 20', 30, 30' are spread. As of a predetermined first lifting height an elevating mechanism 110, 110' supports the spreading of the two scissor bars 20, 20', 30, 30', which will be described in more detail below. For the lifting cylinder 90, 90' mostly two pressure means cylinders arranged adjacent to each other are used in order to avoid the punch guide being stressed too strongly in the lifting cylinder 90, 90' when the load is non-uniformly distributed on the platform.

In a manner similar to the lower scissor bar 20, 20', the upper scissor bar 30, 30' is respectively formed by upper support bars 31, 32, 31', 32' that are articulatedly connected with their lower conical ends to a respective upper section of the associated lower support bar 21, 21', 22, 22' through bearing bolts 25, 25'. The two upper support bars 31 and 32 and the two upper support bars 31' and 32' are respectively articulatedly connected to each other by bearing bolts 50, 50'.

As shown in FIG. 1, a respective support rail or running rail 70, 70' is supported on the upper ends of the upper scissor bar 30, 30' which rail has a contact area 80, 80' on the upper surface thereof. To the front end of the rail 70, 70', the left end in FIG. 1, a drive-on ramp 130 is coupled. The rail 70, 70' has two vertically angled side walls 81, 81' next to the plane contact surface 80, 80' as well as on the opposite side 82, 82' thereof. The length of the rail 80, 80' may be set by means of an extension mechanism 140 depending on the wheel base of the motor vehicle to be checked. Further explanations as to the operation of the extension mechanism 140 can be found with respect to FIGS. 16 to 21.

A vehicle to be lifted can drive onto the lowered rails 70, 70' with its wheels via the ramps 120, 120' or 130, 130'. Next, the vehicle is turned off and the double scissor lifting platform 1 is lifted to a lifted position by controlled pressure means supply to the lifting cylinders 90, 90'. In the predetermined extension position or at the requested lifting height, as illustrated, for example, in FIG. 1, the lower scissor mechanism 20, 20' is locked in the floor area and the upper scissor mechanism 30, 30' is locked on the rails 70, 70' via a safety mechanism (not shown) so that the scissor bars 20, 20', 30, 30' and thus the entire double scissor lifting platform 1 is securely fixed in the desired position.

Furthermore, the double scissor lifting platform 1 has a control pad 200 with which the operation thereof is controlled by the operating staff. For this purpose, the control pad 200 has a plurality of control elements (not shown) by means of which e.g. the lifting and lowering of the rails 70, 70' can be started or stopped.

Figure 3:
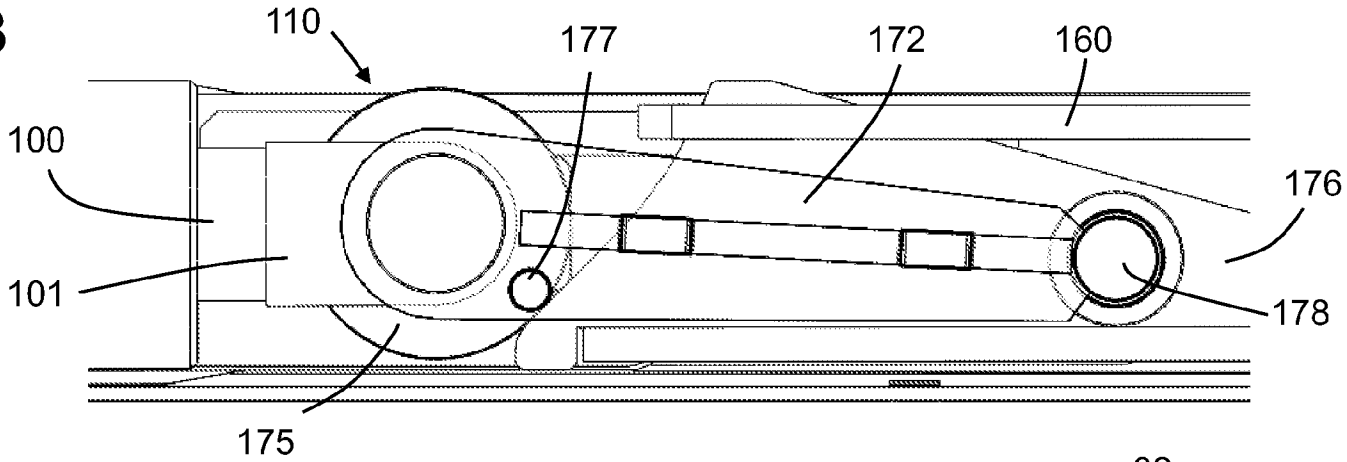
FIG. 3 shows a sectional view of the elevating mechanism for the scissor lifting platform according to FIG. 1 in a lowered state.
Figure 4:
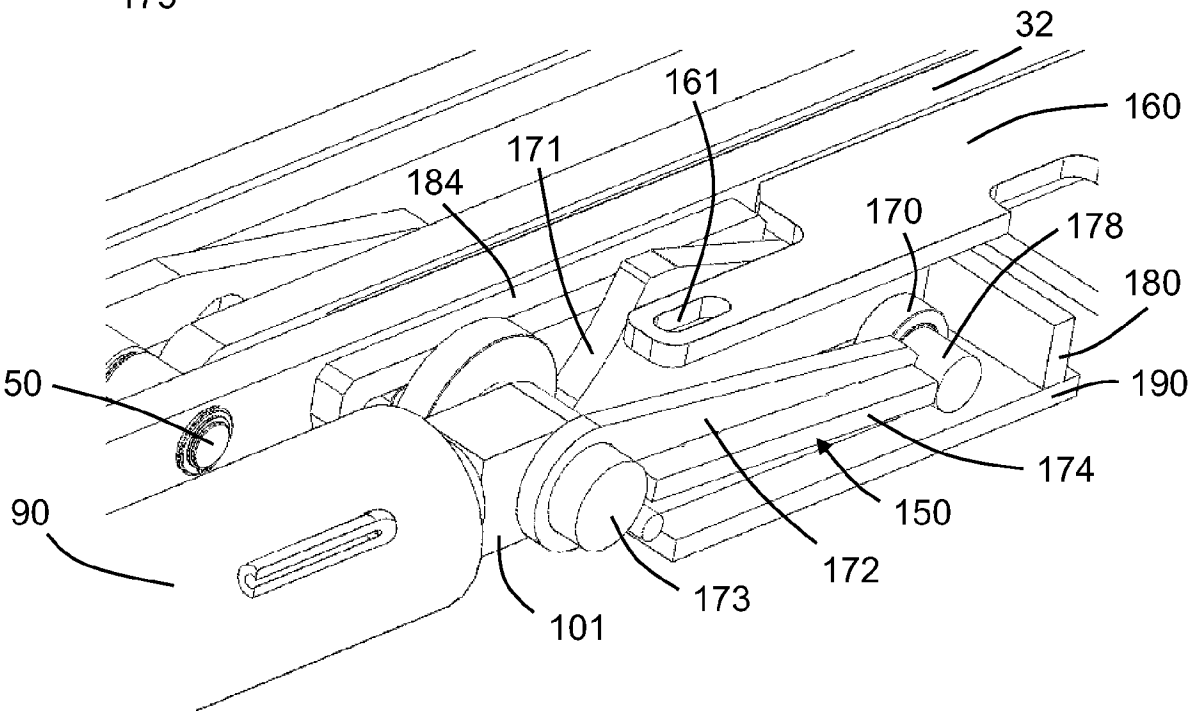
FIG. 4 shows a perspective view of the elevating mechanism according to FIG. 3.

Referring to FIGS. 3 and 4, the features and functions of the elevating mechanism 110, 110' will now be described. The double scissor lifting platform 1 is in the lowered position provided for driving a motor vehicle thereon. In this case the lifting height is 100 mm although the lifting cylinder 90 is disposed in the retracted position and the two scissor bars 20, 20 are disposed on one plane. The lifting height results from the distance from the floor level to the top surface of the rail 70.

The sectional view from the side according to FIG. 3 shows the head 101 of the piston rod 100 having a cuboid design in the connection area with the piston rod 100, the width thereof being smaller than the diameter of the lifting cylinder 90. The head 101 has a rounded design at its free end. Furthermore, the head 101 has a bore (not shown) for accommodating a bolt 173, the bolt 173 extending in a transverse direction to the longitudinal axis of the piston rod 100 of the lifting cylinder 90. The length of the bolt 173 extends across the entire distance between the inner sides of two adjacently arranged upper scissor bars 30.

An expansion lever 150 is connected in a torsionally rigid manner to the bolt 173, the bolt 173 being accommodated in the area of a longitudinal end of the expansion lever 150. The expansion lever 150 is disposed directly adjacent to the head 101 in the transverse direction to the piston rod 100 on that side of the head 101 which points away from the upper scissor bar 30.

The expansion lever 150 consists of a plate-shaped middle section 174 and a respective longitudinal strut 172 formed in the outer area of the expansion lever 150. The longitudinal struts 172 have a taper in a direction leading away from the bolt 173. The thicknesses of the longitudinal struts 172 are respectively less than the width of the head 101. In the area of the free longitudinal end of the expansion lever 150 an essentially cylindrically designed section 178 is formed for accommodating and supporting two rolls 170. The roll 170 is rotatably supported on the cylindrical section 178, the rolls 170 being each disposed in the outer area of the cylindrical section 178. The rolls 170 are each arranged symmetrically to the longitudinal direction of the plate-shaped middle section 174. Thus, the expansion lever 150 is a symmetrical component.

The rolls 170 are in contact with an expansion lever retainer 190 disposed in the range of the bottom side of the upper support bar 32. The expansion lever retainer 190 has an essentially plate-shaped design extending across the entire width between the adjacent upper support bars 32 of the upper scissor bars 30. A stop 180 is formed in the area of a longitudinal end of the expansion lever retainer 190, which stop extends orthogonally to the top surface of the expansion lever retainer 190 and away from the latter up to a height which is greater than the radius of the roll 170. The stop 180 also extends across the entire with between the adjacent upper support bars 32 of the upper scissor bars 30.

A guide 184 is disposed on the inner side of the upper support bar 32, which applies forces for lifting or lowering the double scissor lifting platform 1 from the head 101 of the lifting cylinder 90 to the upper scissor bar 30 via a sliding pad 183 (not shown) and also to the lower scissor bar 20 via the mechanical connection with the same. A lifting auxiliary member in the shape of a starting roll 175 is disposed between the sliding pad 183 and the head 101 of the piston rod 100.

A functional strut 176 is formed on the top surface of the expansion lever retainer 190, which forms a ramp area 171 in the range of that longitudinal end which points in the direction towards the head 101. The ramp area 171 has a convex design in the range of the expansion lever retainer 190, which changes to a concave design in the central range of the functional strut 176. The height of the functional strut 176 is greater than the height of the upper support bar 32.

Figure 5:
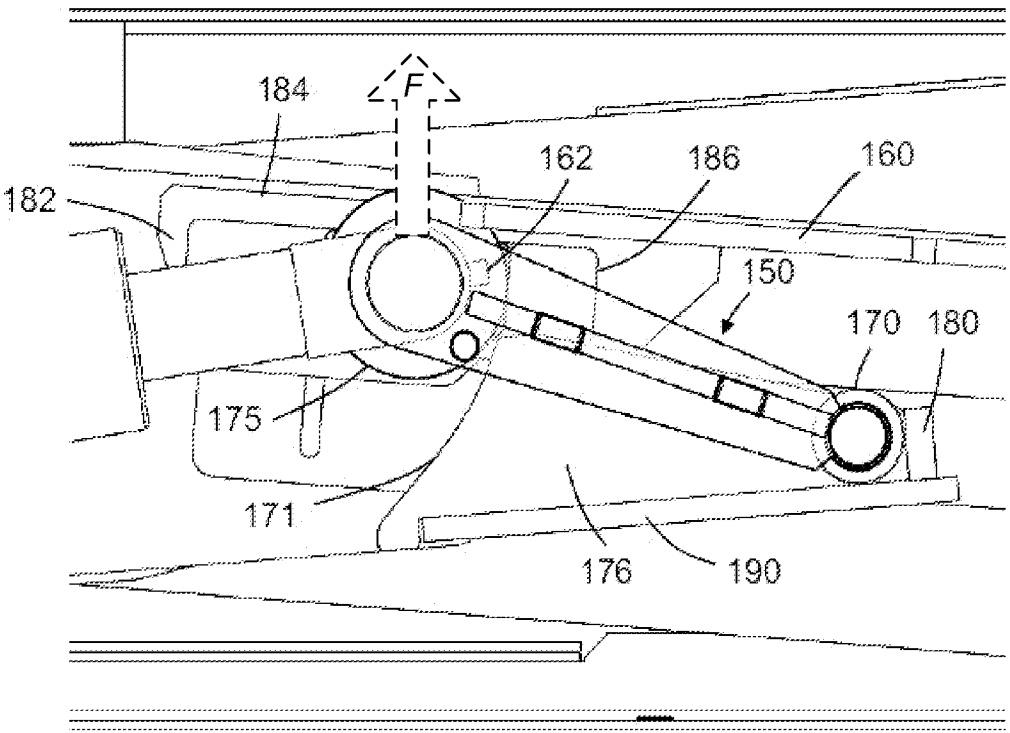
FIG. 5 shows a sectional view of the elevating mechanism for the scissor lifting platform according to FIG. 1 at a lifting height of 300 mm.
Figure 6:
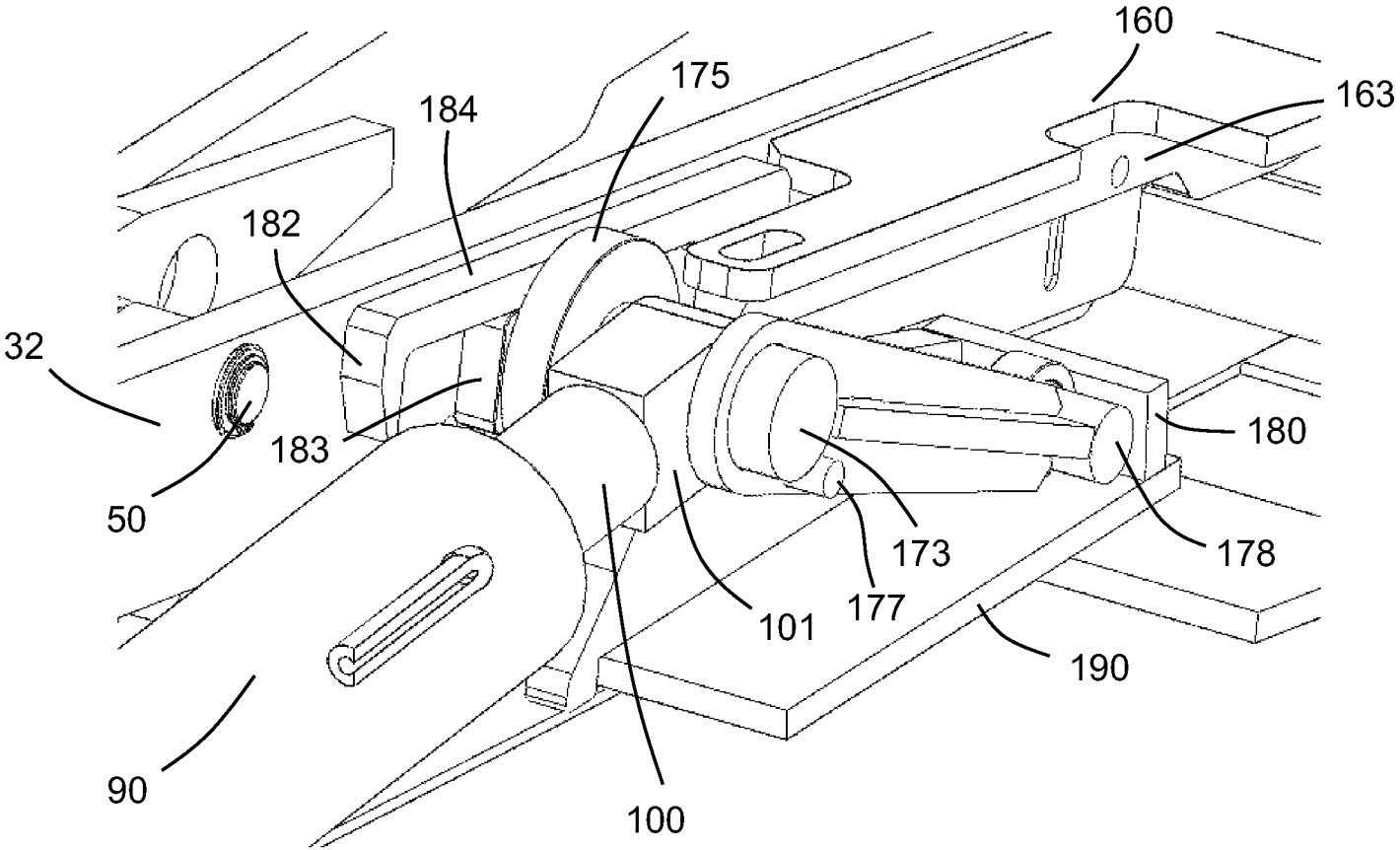
FIG. 6 shows a perspective view of the elevating mechanism according to FIG. 5.

FIGS. 5 and 6 show the elevating mechanism 110 for the double scissor lifting platform 1 according to FIG. 1 at a lifting height of 300 mm. The lifting of the double scissor lifting platform 1 from the lowered position is performed in various phases in which respective different components contribute the main contribution for the application of the vertical force component. Below, the first phase of the lifting will be described, i.e. that phase in which the lifting height is between 100 mm (lowered position) and approximately 300 mm.

Starting from the retracted state of the piston rod 100, the latter is extended by pressurization with the compressed medium, whereby the starting rolls 175 supported on the head 101 move along the ramp area 171. Upon the extension of the piston rod 100 the movement thereof is transferred to the sliding pad 183 via the head 101 and the bolt 173 connected to the head 101, the sliding pad 183 working together with the inner side of the guide 184. The guide 184 in turn transfers the force components introduced by the sliding pad 183 to the upper scissor bars 30. The technical function of this ramp construction is based on a reduction of the necessary extension forces for the piston rod 100 at the start of the extension because the horizontal arrangement of the lifting cylinder 90 at this time cannot yet provide any noteworthy vertical force component. At this time, the static friction of the resting components and arrangements of bearings in the scissor mechanism must be overcome and the weight of the scissor mechanism, the rail and the vehicle must be counteracted. The presence of the ramp area 171 on the one hand allows the extension of the piston rod 100 without an exceedingly large horizontal force component because the static friction is very low due to the relative movement between the guide 184 and the sliding pad 183. On the other hand, the distance between the head 101 and the floor level is increased when the ramp area 171 is passed whereby in addition to the horizontal force component a desired vertical force component is generated already at a low lifting height from the resultant of the piston force, which vertical force component is necessary for spreading the scissor bars 20, 30. At the same time as the starting roll 175 passes the ramp area 171 the expansion lever 150 is moved along the expansion lever retainer 190 in the direction of the stop 180 by means of the roll 170.

The position of the expansion lever 150 and the head 101 according to FIGS. 5 and 6 at the lifting height of 300 mm shows the contact of the rolls 170 both with the stop 180 and the expansion lever retainer 190. Thereby, the expansion lever 150 is subsequently pressed against the two components 180, 190 due to the action of the piston rod 100 which causes a support situation with a translatory fixation of the rolls 170, however, that allows the expansion lever 150 to be pivoted about the rotational axis of the rolls 170. The contact between the starting roll 175 and the ramp area 171 is no longer present at this lifting height, that is, in the subsequent second phase of the lifting, the starting rolls 175 and the ramp area 171 are no longer included in the provision of the vertical force component.

Figure 7:
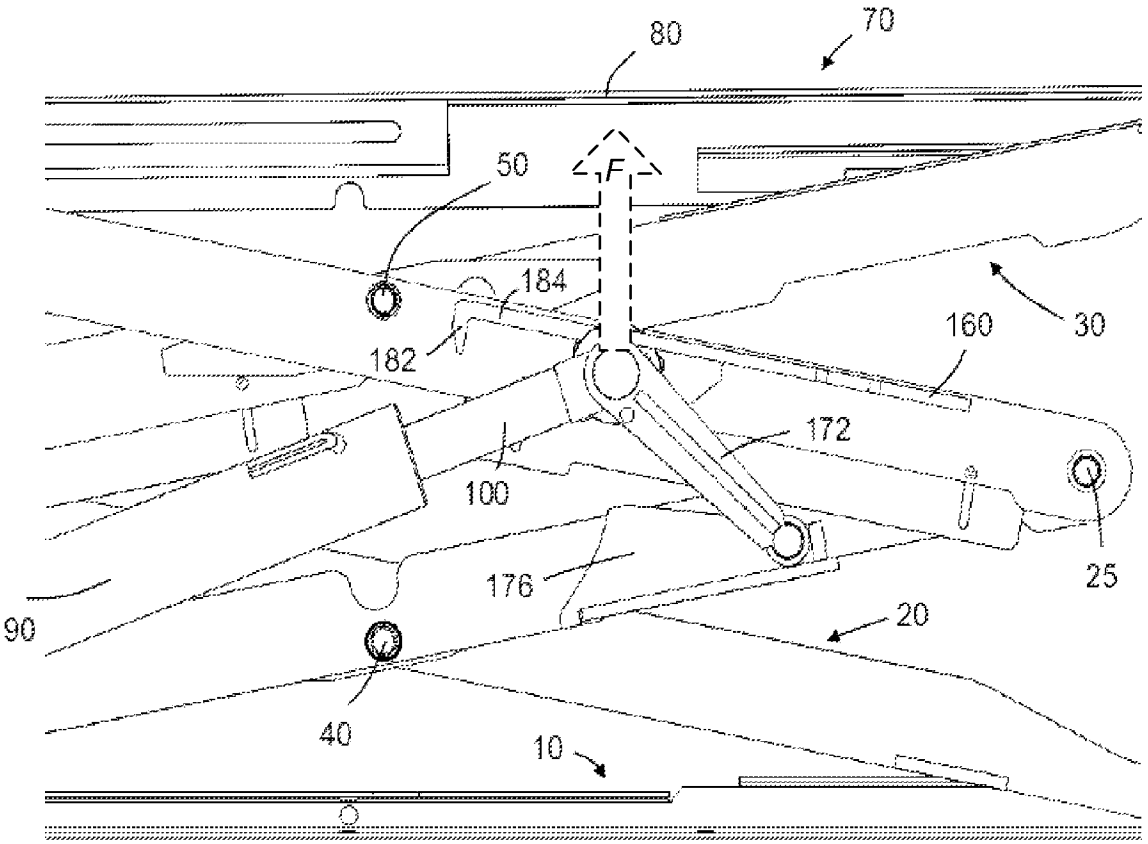
FIG. 7 shows a sectional view of the elevating mechanism for the scissor lifting platform according to FIG. 1 at a lifting height of 600 mm.
Figure 8:
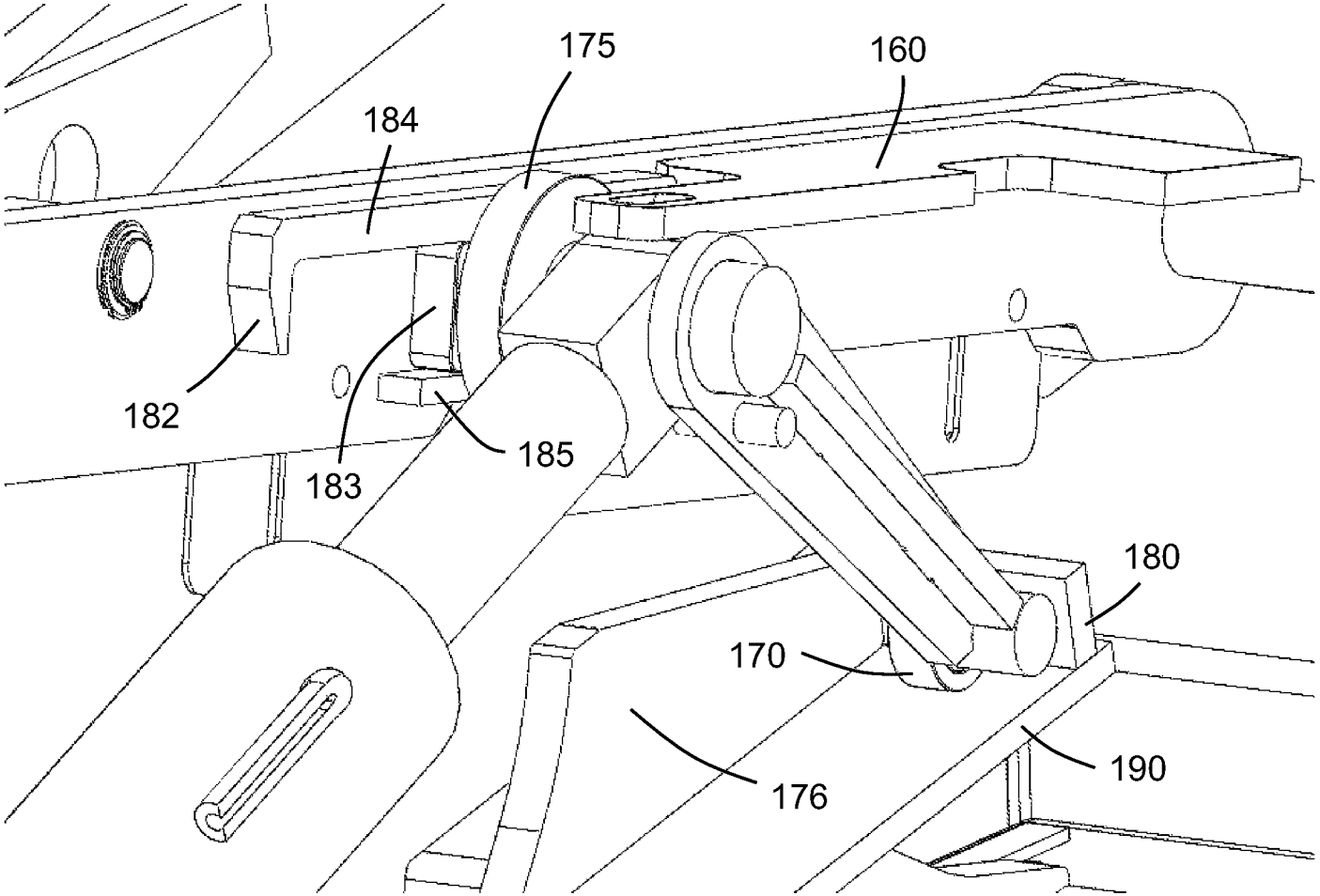
FIG. 8 shows a perspective view of the elevating mechanism according to FIG. 7.

Referring to FIGS. 7 and 8, the effect of the expansion lever 150 is now described in the second phase which in the embodiment as shown substantially takes place in the range between 300 mm and 600 mm for the lifting height. However, this phase may be selected to be different in dependence of the selected length of the expansion lever 150, the height of the ramp area 171 and the bearing site of the sliding pad 183.

In the second phase the sliding pad 183 moves in an axial direction of the guide 184 towards a stop area 186 of the guide 184 under the effect of the lifting cylinder 90, the sliding pad 183 introducing a vertical force component applied by the lifting cylinder 90 via the guide 184 to the upper scissor bar 30, which vertical force component is passed on to the head 101 via the piston rod 100 and into the sliding pad 183 via the bolt 173, which achieves a lifting of the double scissor lifting platform 1.

During the second phase the expansion lever 150 constantly stays in contact with the stop 180 and the expansion lever retainer 190 via the rolls 170 and maintains the above-described support situation. During the second phase the obtuse angle formed between the longitudinal axis of the piston rod 100 and the longitudinal axis of the expansion lever 150 is decreased. This results in an additional vertical force reinforcement under the influence of the expansion lever 150 in this phase due to the lever situation at the site of application of force of the lifting cylinder 90 on the upper scissor bar 30, that is, between the sliding pad 183 and the guide 184, in combination with the increasing vertical force component generated by the increasing angle between the piston rod 100 and the horizontal.

FIGS. 7 and 8 show the expansion lever 150 in the position towards the end of the second phase in which the contact situation between the rolls 170 and the stop 180 and the expansion lever retainer 190 is still existent, the support effect, however, is already decreased.

Figure 9:
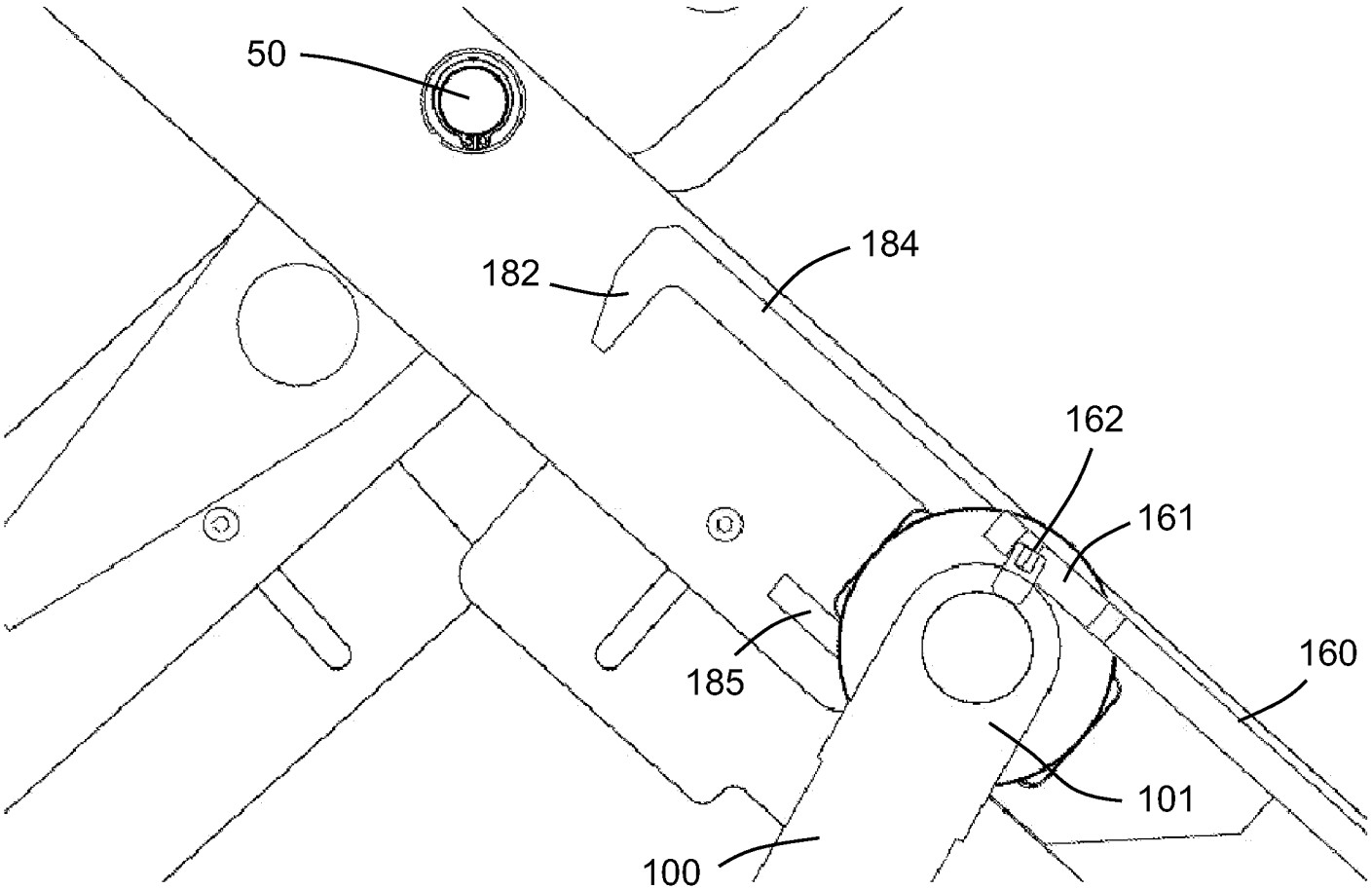
FIG. 9 shows a sectional view of the elevating mechanism for the scissor lifting platform according to FIG. 1 at a lifting height of 1900 mm.
Figure 10:
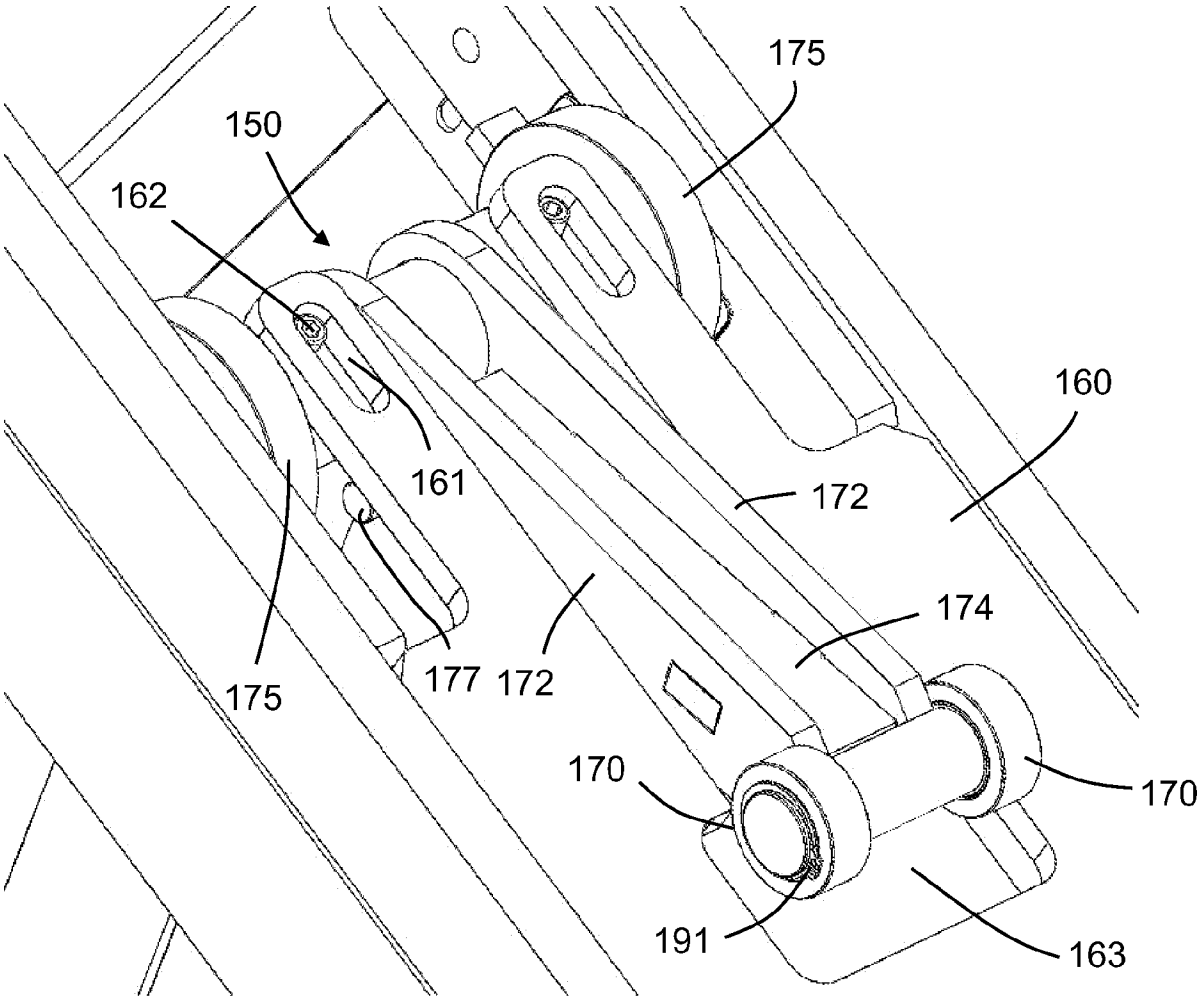
FIG. 10 shows a perspective view of the elevating mechanism according to FIG. 9.

FIGS. 9 and 10 show the double scissor lifting platform 1 in a third phase in which the lifting height is approximately 1900 mm and the maximum lifting height of the rail 70 has been substantially reached. In the arrangement according to FIGS. 9 and 10, the area of the rolls 170 of the expansion lever 150 is above a stop plate 160 that connects opposite upper scissor bars 30 with each other. The stop plate 160 has a recess 163 formed such that a section of the expansion lever 150 may move through the recess 163.

After the end of the second phase and before the start of the third phase, the head 101 of the piston rod 100 and a draw nail 177 formed on the bottom side of the expansion lever 150 approach each other. As soon as the draw nail 177 and the head 101 have come into contact with each other, the head 101 carries along the draw nail 177 during the further extension of the piston rod 100 whereby the expansion lever 150 is released from the contact situation of the second phase with the stop 180 and the expansion lever retainer 190. The height of the stop 180 is selected such that on the one hand a safe support of the rolls 170 during the second phase is achieved and on the other hand the release of this support situation after the end of the second phase, which is triggered by the influence of the head 101 and the draw nail 177, however, is achieved safely and without any large process forces. As soon as the expansion lever 150 has detached from the stop 180 and the expansion lever retainer 190, the limitation screw 162 is in contact with the elongated hole 161 whereby an uncontrolled shift of the head 101 towards the area 182 on the guide 184 is prevented.

Furthermore, FIGS. 9 and 10 show the contact of a limitation screw 162 mounted on the head 101 and projecting from the top surface of the heat 101 with a limitation recess 161 formed in the stop plate 160 in the shape of an elongated hole. The limitation recess 161 is formed in the stop plate 160 in the range of an inwardly directed longitudinal end, that is, in a direction towards the head 101. The limitation recess 161 accommodates the limitation screw 162 in the third phase and meanwhile prevents the head 101 from being shifted inwardly, that is, away from the stop area 186 towards the opposite hook area 182.

Figure 12:
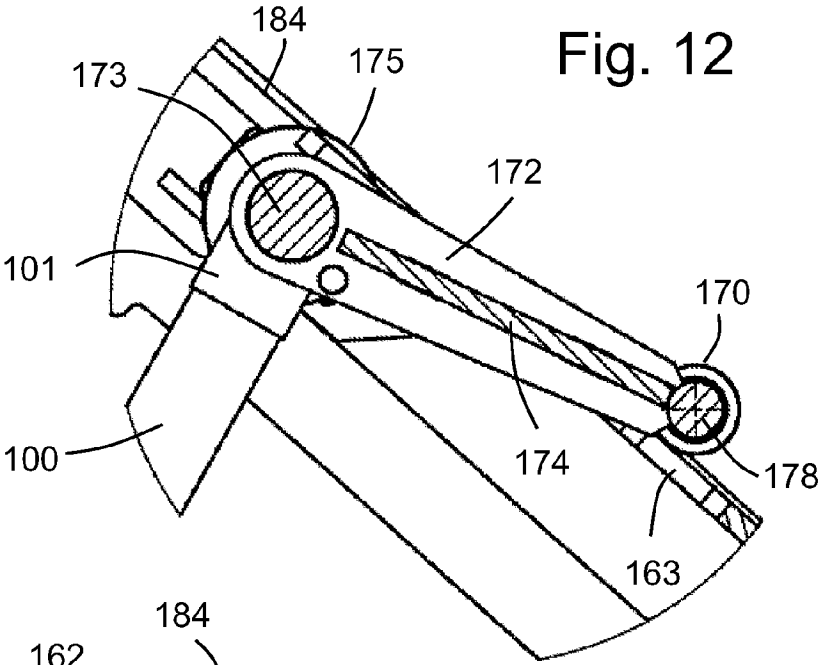
FIG. 12 shows an enlarged sectional view from the side for section w of the elevating mechanism according to FIG. 11.
Figure 13:
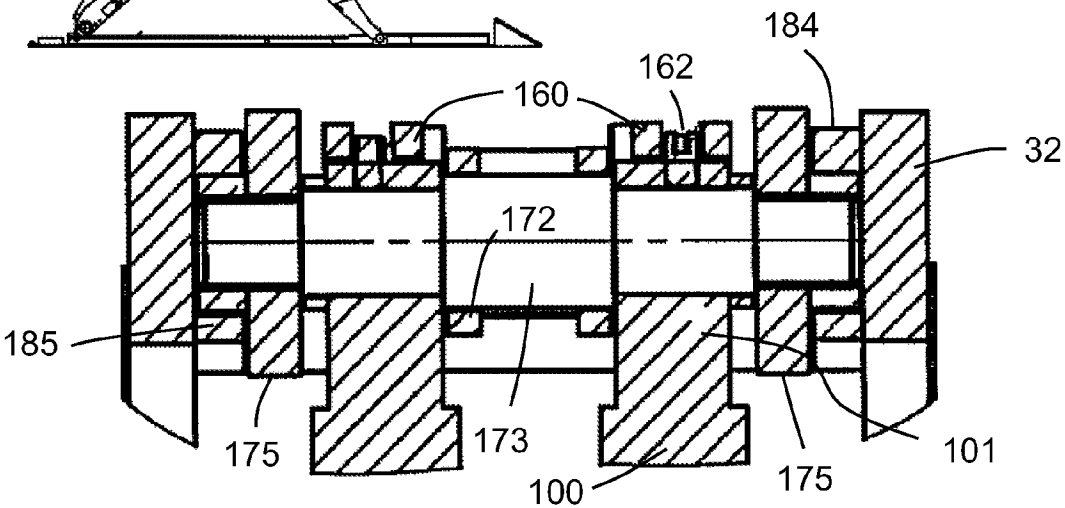
FIG. 13 shows a sectional view of the elevating mechanism according to FIG. 11 along section line A-A.
Figure 11:
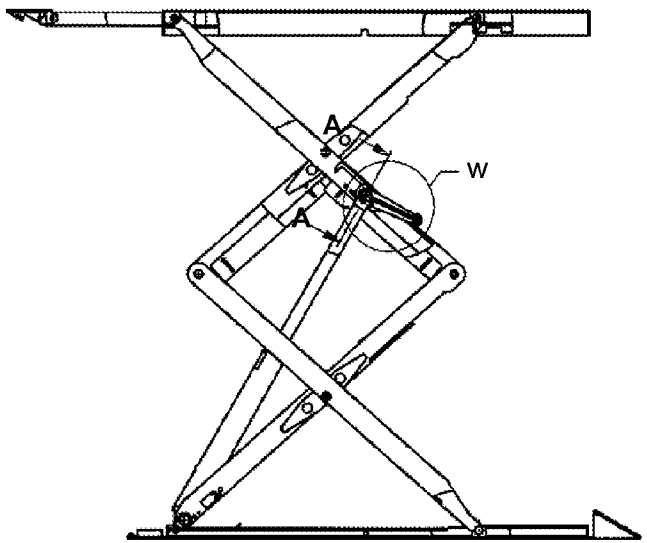
FIG. 11 shows a side view of the scissor lifting platform according to FIG. 1 in an extended state.

Referring to FIGS. 11 to 13, an inventive double scissor lifting platform 1 according to FIG. 1 is shown in the third phase. FIG. 12 shows an enlarged sectional view from the side of section w according to FIG. 11.

FIG. 13 shows a sectional view along section line A-A according to FIG. 11. The bolt 173 has different sections of respectively different diameters for connection with the above-described components, the diameter decreasing from the center towards the longitudinal ends. FIG. 13 again clarifies the symmetrical structure of the expansion lever 150 and the double scissor mechanism 20, 30.

Figure 14:
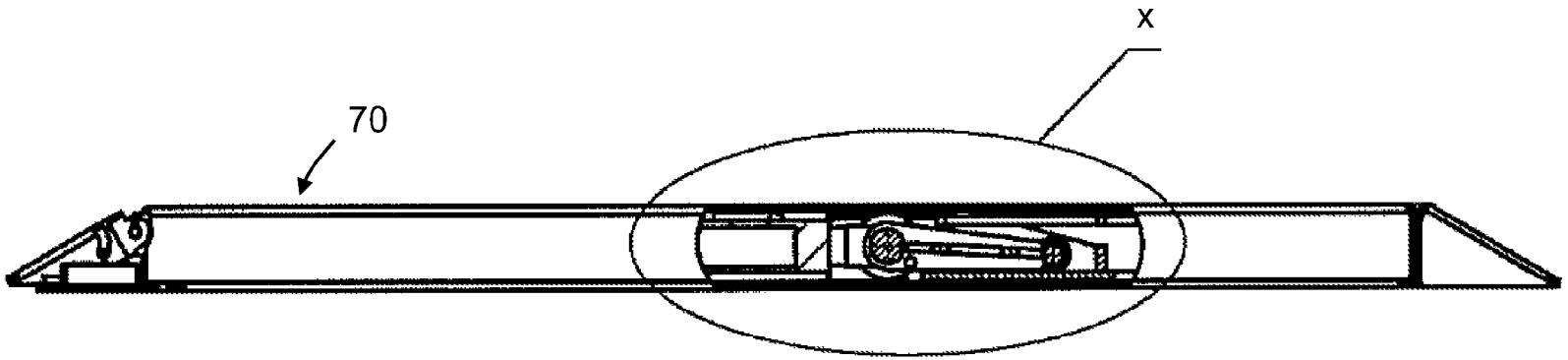
FIG. 14 shows a partial sectional view from the side for the scissor lifting platform according to FIG. 1 in a retracted state.
Figure 15:
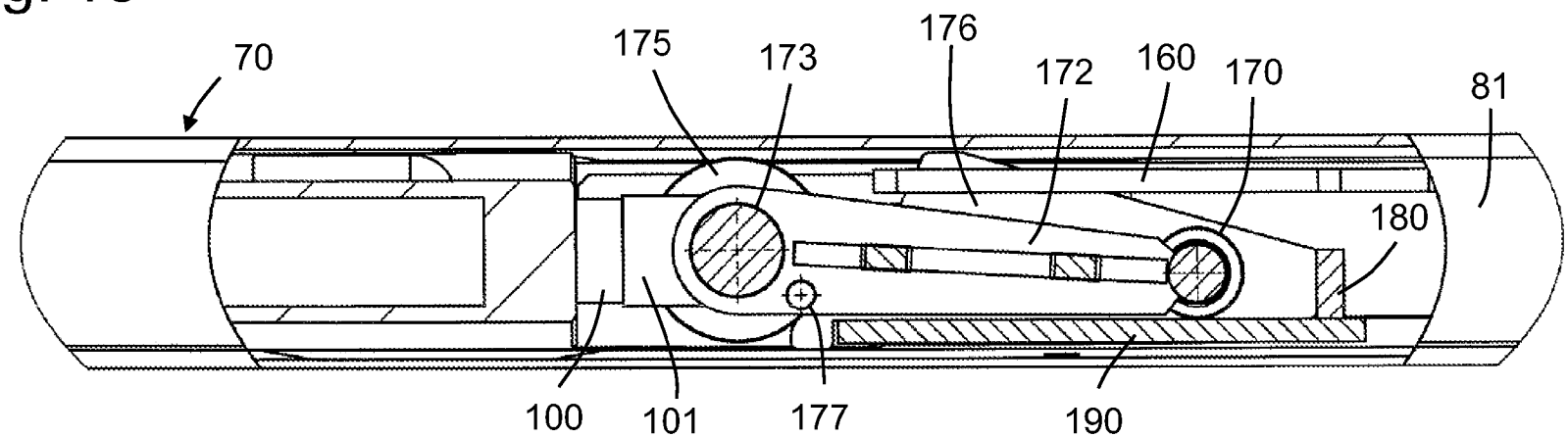
FIG. 15 shows an enlarged partial sectional view of the elevating mechanism in section x of the scissor lifting platform according to FIG. 14.
Figure 16:
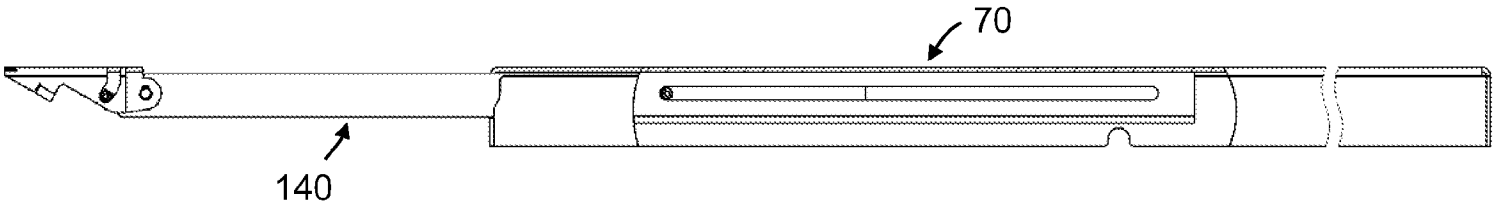
FIG. 16 shows a partial sectional side view of a rail comprising an extension mechanism for the scissor lifting platform according to FIG. 1.
Figure 17:
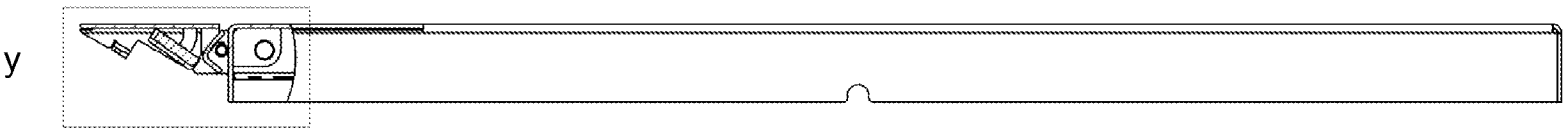
FIG. 17 shows a sectional view from the side for the rail according to FIG. 16 with the drive-on ramp tilted upward.
Figure 18:
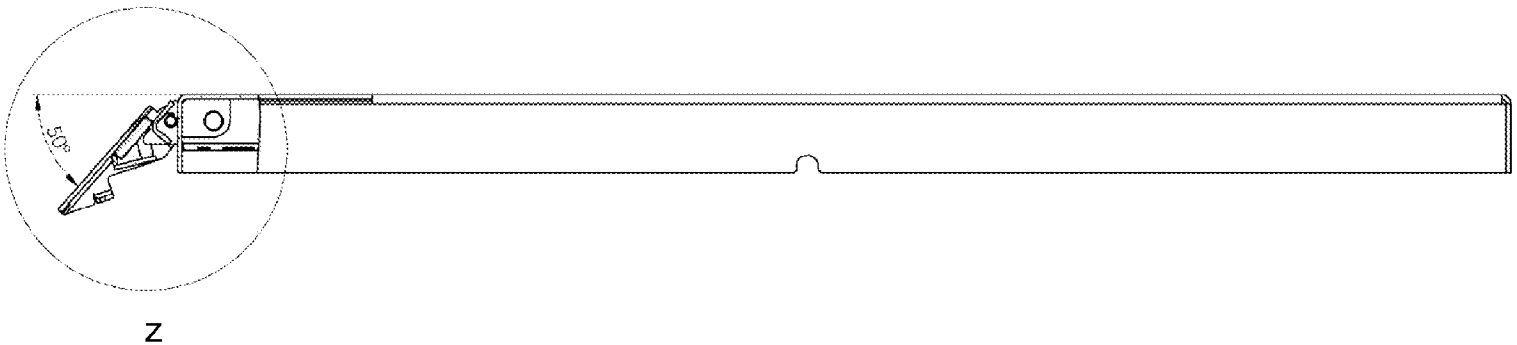
FIG. 18 shows a sectional view from the side for the rail according to FIG. 16 with the drive-on ramp lowered.

FIGS. 14 and 15 show the double scissor lifting platform 1 according to the invention in a partial sectional view from the side in a lowered state.

The mode of operation of the elevating mechanism 110 is to be described here in summary. To this end, the effect of the elevating mechanism can be divided in three phases occurring during the lifting of the double scissor lifting platform 1 in the described sequence.

In the first phase the piston rod 100 is in the retracted state and located in a substantially horizontal orientation. When the piston rod 100 is extended from the resting position in the lowered position of the double scissor lifting platform 1, the starting roll 175 supported on the head 101 via the bolt 173 is moved along the ramp area 171. When the piston rod 100 is extended, the movement thereof is transferred to the sliding pad 183 via the head 101 and the bolt 173 connected to the head 101, the sliding pad 183 working together with the guide 184. The guide 184 in turn transfers the force components applied by the sliding pad 183 to the upper scissor bars 30. Due to the design of the ramp area 181 pointing away from the floor, the distance between the floor level and the bottom side of the starting rolls 175 increases in the first phase. At the same time of the starting roll 175 passing the ramp area 171, the expansion lever 150, which is connected to the head 101 via the bolt 173, is moved along the expansion lever retainer 190 towards the stop 180, the roll 170 being in contact with the expansion lever retainer 190.

The second phase begins as soon as an end-side area of the expansion lever 150 (here the roll 170) is in contact with both the stop 180 and the expansion lever retainer 190. Thus, the expansion lever 150 is subsequently pressed against the two components 180, 190 due to the action of the piston rod 100 whereby a support situation of the rolls 170 with the stop 180 and the expansion lever retainer 190 with a translatory fixing of the rolls 170 is generated which, however, allows the expansion lever 150 to be pivoted about the rotational axis of the rolls 170.

During the second phase the expansion lever 150 constantly remains in contact with the stop 180 and the expansion lever retainer 190 via the rolls 170 and maintains the above-described support situation. The contact between the starting roll 175 and the ramp area 171 no longer exists in the second phase, that is, the starting roll 175 and the ramp area 171 are no longer included in the provision of the vertical force component. During the second phase the obtuse angle formed between the longitudinal axis of the piston rod 100 and the longitudinal axis of the expansion lever 150 is reduced. The sliding pad 183 continues to be moved under the influence of the movement of the piston rod 100 as against the guide 184 and applies a vertical force component in the above-described manner into the scissor bars 20, 30 via the guide 184.

Due to the lever situation at the site of application of force of the lifting cylinder 90 to the upper scissor bar 30, that is, between the sliding pad 183 and the guide 184, in combination with the increasing vertical force component resulting from the increasing angle between the piston rod 100 and the horizontal, an additional vertical force reinforcement in dependence of the position of the expansion lever 150 results in the second phase.

In the third phase the draw nail 177 and the head 101 are in contact with each other, whereby the expansion lever 150 is released from the contact situation of the second phase, namely the contact thereof with the stop 180 and the expansion lever retainer 190, by the expansion lever 150 and the draw nail 177 working together. The height of the stop 180 is selected such that on the one hand a safe support of the rolls 170 during the second phase is achieved and on the other hand the reversal of this support situation after the end of the second phase is achieved securely and without any large process forces. As soon as the expansion lever 150 has detached from the stop 180 and the expansion lever retainer 190, the limitation screw 162 is in contact with the elongated hole 161, whereby an uncontrolled shift of the head 101 towards the area 182 on the guide 184 is prevented. The vertical force for further lifting the double scissor lifting platform 1 in the third phase is provided completely by the lifting cylinder 90 and, as described above, applied to the upper scissor bar 30 via the sliding pad 183 and the guide 184.

FIGS. 16 to 21 show a rail 70 comprising an elevating mechanism 140, whereby the axial length of the rail 70 may be changed in order to lift vehicles of different wheel bases on a double scissor lifting platform 1.

The extension mechanism 140 comprises a first extension member 201 and a second extension member 202 each accommodated by a correspondingly shaped accommodation section 240, 250 in the rail 70. The extension members 201, 202 are profiled rods movably guided in an axial direction in the associated accommodation section 240, 250. At the free longitudinal end of the extension mechanism 140 a drive-on plate 200 is disposed which is rotatably connected to the extension members 201, 202 wherein the drive-on plate 200 may assume an inclined position of according to FIG. 20, for example for driving the vehicle thereon, and a position according to FIG. 19 for lifting or lowering. Furthermore, the extension mechanism 140 may have a stop (not shown) which serves to limit the axial shift of the extension members 201, 202 away from the rail 70.

Figure 19:
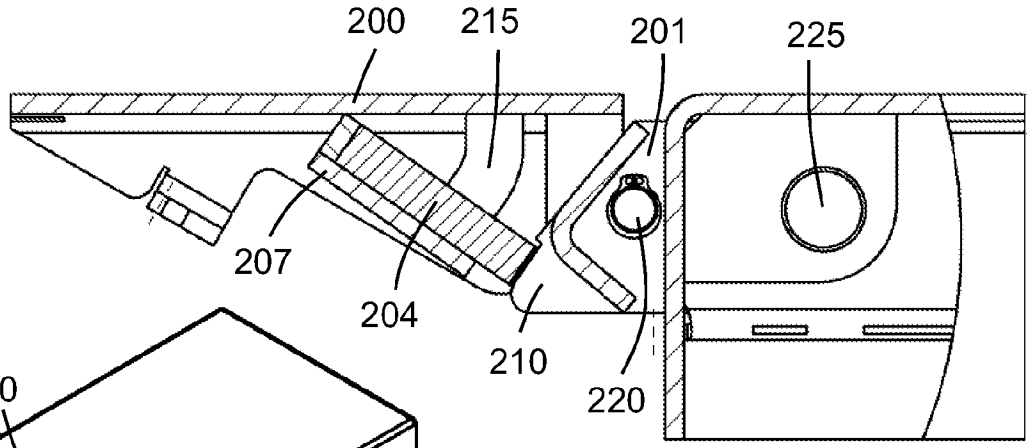
FIG. 19 shows an enlarged sectional view of section y of the drive-on ramp according to FIG. 17.
Figure 20:
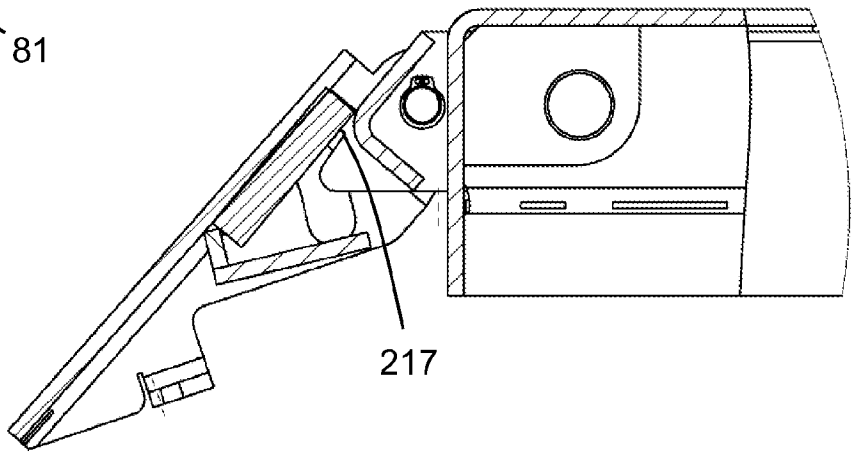
FIG. 20 shows an enlarged sectional view of section z of the drive-on ramp according to FIG. 18.
Figure 21:
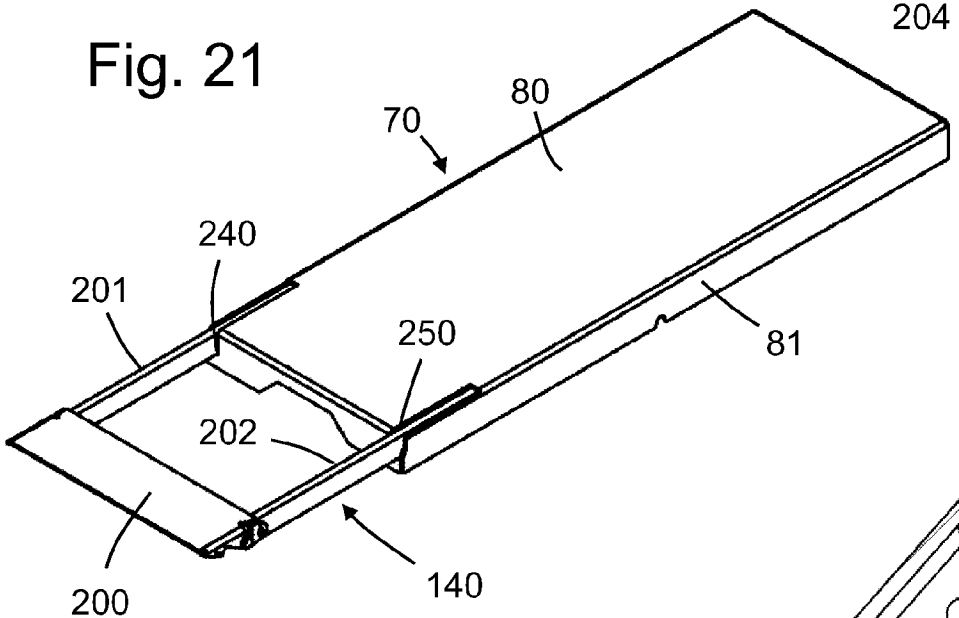
FIG. 21 shows a perspective view of the rail for the scissor lifting platform according to FIG. 1 with the extension mechanism extended.

Referring to FIGS. 19 and 20, the structure of the area beneath the drive-on plate 200 for the locking thereof will be described in more detail. The drive-on plate 200 is rotatably connected to the extension members 201, 202 on a lateral bent-off section via a respective bolt 220, a securing ring preventing the bolt 220 from coming loose. In the area of the free longitudinal end of the extension members 201, 202 a respective connection range 210 is formed which has a substantially triangular design. In the lower area of the connection range 210 a locking recess 217 is formed on the surface thereof which serves to accommodate a locking member 204. The locking member 204 is a cuboid body the width of which essentially corresponds to the width of the rail 70. In the elevated position according to FIG. 19 the locking member 204 is connected both with the locking recess 217 and an L-shaped member retainer 207 which accommodates a section of the locking member 204 in the area below the drive-on plate 200, whereby the locking member 204 supports the drive-on plate 200 against the locking recess 217. The locking member 204 is connected to a lever 215 at the longitudinal ends thereof.

If now the drive-on plate 200 is to be brought into an adequate position according to FIG. 20 for driving the vehicle on or off, the drive-on plate 200 must be pivoted again. The support effect of the locking member 204 is reversed by now bringing that longitudinal end which is in contact with the locking recess 217 while the drive-on plate 200 is elevated out of the range of the locking recess 217 towards the drive-on plate 200 by means of the lever 215. In a holding position the locking member 204 and the drive-on plate 200 are then disposed next to each other. Subsequently, the drive-on plate 200 can be pivoted as against the extension elements 201, 202.

The above description of illustrated embodiments of the invention, including what is described in the abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description.

The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

The invention claimed is:

1. A scissor lifting platform comprising:

at least two crossing lower scissor bars;

at least two crossing upper scissor bars, each upper scissor bar articulatedly connected to a corresponding lower scissor bar;

a lower joint connecting the two lower scissor bars with each other;

an upper joint connecting the two upper scissor bars with each other;

at least one lifting aggregate having at least one operating rod connected to one of the upper scissor bars or to one of the lower scissor bars, wherein the operating rod works together with an elevating mechanism for lifting and reinforcing a vertical force up to a predetermined lifting height of the scissor lifting platform; and at least one rail having at least one contact area and being supported on the upper scissor bars, one of the upper scissor bars being articulatedly connected to the at least one rail and the other one of the upper scissor bars being guided by the at least one rail so as to be movable in a longitudinal direction when the scissor lifting platform moves;

wherein the elevating mechanism includes:

at least one expansion lever coupled to the operating rod, and an expansion lever retainer provided on the corresponding lower scissor bar if the operating rod is connected to one of the upper scissor bars or provided on the corresponding upper scissor bar if the operating rod is connected to one of the lower scissor bars;

wherein the expansion lever is in contact with the expansion lever retainer up to first and second predetermined lifting heights of the scissor bars; and wherein the lifting aggregate is a hydraulic lifting cylinder and the operating rod is a piston rod of the hydraulic lifting cylinder.

2. The scissor lifting platform of claim 1 wherein the at least one expansion lever is articulatedly connected to a head of the operating rod.

3. The scissor lifting platform of claim 2 wherein the expansion lever has at least one rotatable roll at a longitudinal end thereof.

4. The scissor lifting platform of claim 1 wherein the expansion lever retainer has a stop, the expansion lever exercising a reinforcing vertical force component on the operating rod and thus on the scissor bar connected to the operating rod in case of an end-side contact with the expansion lever retainer and the stop.

5. The scissor lifting platform of claim 1 wherein the elevating mechanism has a lifting auxiliary member that is disposed at a head of the operating rod on the opposite side of the expansion lever.

6. The scissor lifting platform of claim 5 wherein the lifting auxiliary member is in contact with a ramp area that extends upward from the expansion lever retainer and is connected to the scissor bar to which the operating rod is connected when the operating rod is extended from a lowered position.

7. The scissor lifting platform of claim 1 wherein a contact means is provided at the head of the operating rod, which works together with a guide disposed on the scissor bar that is connected to the operating rod, and allows force to be transferred between the operating rod and the scissor bar.

8. The scissor lifting platform of claim 7 wherein the contact means is a sliding pad that transfers an application of force of the operating rod to the scissor bar connected to the operating rod via the guide and moves relative to the guide upon an extending movement of the operating rod.

9. The scissor lifting platform of claim 7 wherein the guide has a hook-shaped section in the range of an inwardly turned longitudinal end, which section limits the movement of the contact means in one direction.

10. The scissor lifting platform of claim 1 wherein in a lowered position the operating rod is disposed in a substantially horizontal manner.

11. The scissor lifting platform of claim 1 wherein a stop plate is arranged in a section of the scissor bar connected to the operating rod.

12. The scissor lifting platform of claim 11 wherein the stop plate has a limitation recess in a section of an inwardly turned longitudinal end, which limitation recess accommodates a limitation means disposed in the head of the operating rod and prevents the head from being shifted in an inward direction above a third predetermined lifting height.

13. The scissor lifting platform of claim 7 wherein the operating rod is in operative connection with the first and second upper scissor bars via the contact means and the guide.

14. A scissor lifting platform comprising:

at least two crossing lower scissor bars;

at least two crossing upper scissor bars, each upper scissor bar articulatedly connected to a corresponding lower scissor bar;

a lower joint connecting the two lower scissor bars with each other;

an upper joint connecting the two upper scissor bars with each other;

at least one lifting aggregate having at least one operating rod connected to one of the upper scissor bars or to one of the lower scissor bars, wherein the operating rod works together with an elevating mechanism for lifting and reinforcing the vertical force up to a predetermined lifting height of the scissor lifting platform; and at least one rail having at least one contact area and being supported on the upper scissor bars, one of the upper scissor bars being articulatedly connected to the at least one rail and the other one of the upper scissor bars being guided by the at least one rail so as to be movable in a longitudinal direction when the scissor lifting platform moves;

wherein the elevating mechanism includes:

at least one expansion lever coupled to the operating rod, and an expansion lever retainer provided on the corresponding lower scissor bar if the operating rod is connected to one of the upper scissor bars or provided on the corresponding upper scissor bar if the operating rod is connected to one of the lower scissor bars; and a stop plate arranged in a section of the scissor bar connected to the operating rod and wherein the stop plate has a limitation recess in a section of an inwardly turned longitudinal end, which limitation recess accommodates a limitation means disposed in the head of the operating rod and prevents the head from being shifted in an inward direction above a third predetermined lifting height.

* * * * *